United States Patent [19]

Kuffner

[11] 4,179,849

[45] Dec. 25, 1979

[54] DOOR FRAME ASSEMBLY

[75] Inventor: Reinhold O. Kuffner, Karlsruhe, Fed. Rep. of Germany

[73] Assignee: Kueffner Products, Inc., Phoenix, Ariz.

[21] Appl. No.: 882,935

[22] Filed: Mar. 2, 1978

[51] Int. Cl.[2] ..... E06B 1/04

[52] U.S. Cl. ..... 49/505; 52/212; 52/213

[58] Field of Search ..... 49/505; 52/212, 213, 52/217

[56] References Cited

U.S. PATENT DOCUMENTS

| | | | |
|---|---|---|---|
| 3,324,599 | 6/1967 | Brost | 49/505 |
| 3,400,492 | 9/1968 | Bell et al. | 52/212 X |
| 3,654,734 | 4/1972 | Lehman | 49/505 |

FOREIGN PATENT DOCUMENTS

| | | | |
|---|---|---|---|
| 2457940 | 12/1974 | Fed. Rep. of Germany | 52/217 |

*Primary Examiner*—Kenneth Downey
*Attorney, Agent, or Firm*—LaValle D. Ptak

[57] ABSTRACT

A door frame assembly is made of first and second aluminum extrusions which may be placed in a door opening in wall after the wall has been completely finished. The structure of the frame assembly inherently compensates for variations in wall thicknss and dimensional errors in the door opening dimensions. Steel anchor plates are fastened to the wall in the door frame opening and the assembly is attached to the anchor plates. Once the completed assembly is in place, all of the attaching members are concealed from view.

9 Claims, 9 Drawing Figures

DOOR FRAME ASSEMBLY

BACKGROUND OF THE INVENTION

The installation of door frames and doors in commercial buildings is generally a time consuming, expensive process. Even with preformed wood or steel door frames, which are set into place prior to the finishing of the wall in which they are used, problems arise in adjusting the precise rectangular dimensions of the door frame and in finishing the wall up to the frame. In the past, it has been necessary to install door frames prior to the final finishing of the wall so that extra care must be taken by the plasterers and painters to avoid getting plaster or paint on the door frame. This additional care also results in higher labor costs in the finishing of the building in which such conventional door frame construction is used.

In addition, most conventional door frame constructions are of predetermined specific dimensions. A number of different sized doors are used in practically every building and it is necessary to buy prefabricated door frame structures uniquely dimensioned to fit the particular door opening size which is desired for each different door. Either this course must be followed, or a custom built door frame must be made in each of the door openings. The latter approach is prohibitive, particularly for commerical construction.

It is desirable to have a door frame construction which is simple, universal for door openings of various sizes, and which may be installed by workmen having minimum skill. In addition, it is desirable to have a door frame construction which can be installed in door openings after finishing of the walls is completed to thereby effect a savings in the labor required to finish the walls around door openings.

SUMMARY OF THE INVENTION

Accordingly, it is an object of this invention to provide an improved door frame assembly.

It is a further object of this invention to provide a door frame assembly which can be installed in door openings after all wall finishing has been completed.

It is an additional object of this invention to provide an improved universal door frame assembly.

It is yet another object of this invention to provide an improved door frame assembly made of first and second mating extrusions.

It is a more specific object of this invention to provide an improved door frame assembly which may be installed by means of concealed fasteners in a door opening in a finished wall.

In accordance with a preferred embodiment of this invention, a door frame assembly includes first and second elongated extrusions each having a generally L-shaped uniform cross-section and each having anchor gripping means integrally formed as part of the extrusion.

One of the extrusions has a door stop extension of a U-shaped cross-section integrally formed with it, and this door stop extension has one leg of the "U" adapted to overlap the other extrusion when the two extrusions are placed on opposite sides of a door opening and moved toward one another. An additional lever is used to clamp the two extrusions together after they are mounted to the anchor, which in turn is attached to the opening in which the door frame assembly is used.

DETAILED DESCRIPTION

Figure 1:
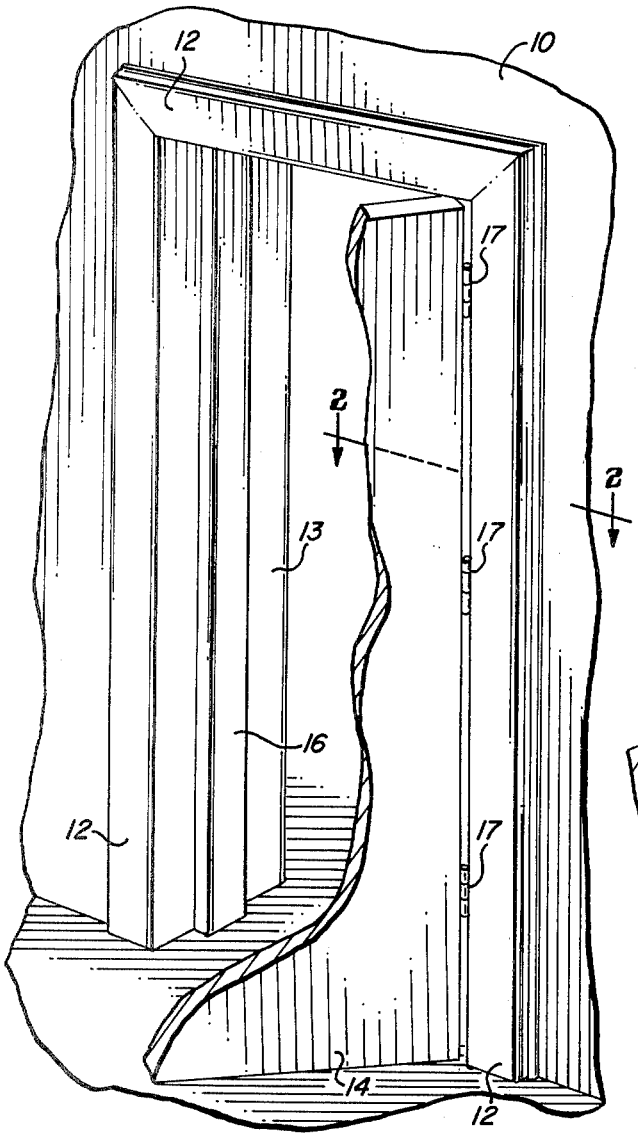
FIG. 1 illustrates a door frame assembly of the invention in place in a door opening.

Referring now to the drawings, the same reference numbers are used throughout the different figures to designate the same or similar components. FIG. 1 shows a typical installation of a door frame and door combination in accordance with a preferred embodiment of the invention installed in an opening in a wall 10. The door frame is comprised of a first extrusion 12 mounted on one side of the door opening and a second mating extrusion 13 mounted on the other side. The extrusions 12 and 13 each have uniform cross-sectional configurations on both sides and on the top of the door opening. A door 14 is mounted on the extrusion 12 on the right-hand side of the door opening as viewed in FIG. 1 by means of conventional hinges 17. The extrusion 12 also has integrally formed as part of the extrusion a door stop portion 16 which is of conventional shape.

Figure 2:
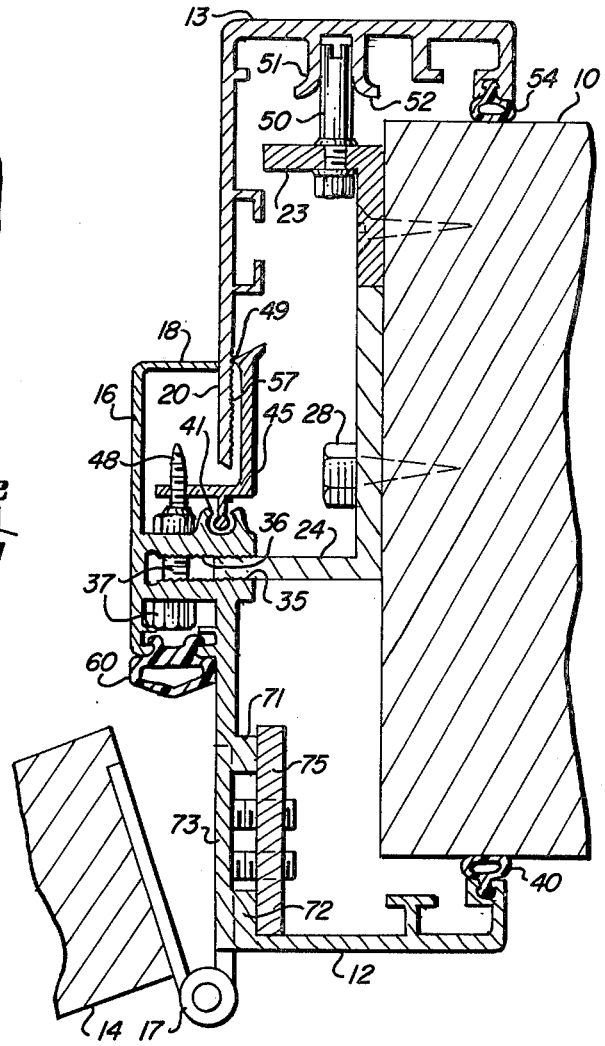
FIG. 2 is a cross-sectional view of the door frame assembly shown in FIG. 1.
Figure 3:
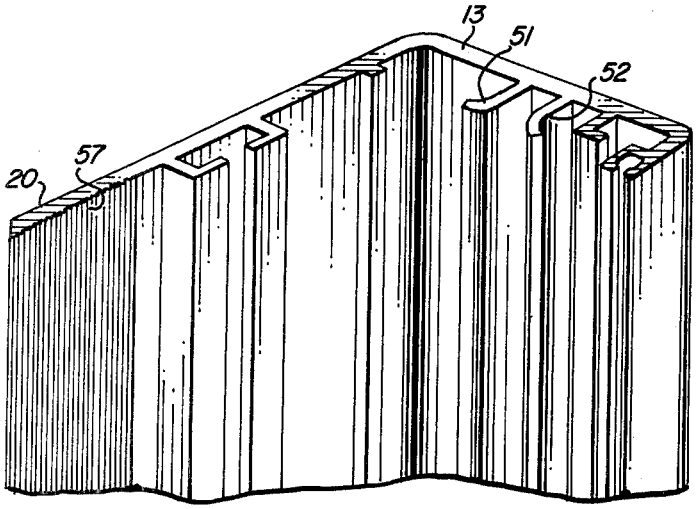
FIGS. 3 and 4 illustrate details of portions of the assembly shown in FIG. 2.

Reference now should be made to FIG. 2 which is a cross-sectional view taken along the lines 2—2 of FIG. 1 to show the details of the extrusions 12 and 13 and the manner in which they are mounted in a door opening in a typical wall 10. As is readily apparent from an examination of FIG. 2, the extrusions 12 and 13 both are of a generally L-shaped cross-sectional configuration. The extrusion 12 has the door stop portion 16 integrally formed with it, and this portion is of a generally U-shaped cross-sectional configuration, terminating in one arm of the "U" 18 which overlaps an elongated extension 20 of the extrusion 13. Since the extrusions 12 and 13 are of uniform cross-section throughout their lengths, they typically may be formed of aluminum or other suitable materials on a continuous basis. The extrusions then are cut to length in accordance with the size of the door opening in which they are to be used. This cutting can be done either on the job or at the manufacturing facility for the extrusions in accordance with the desires of the installer.

Figure 6:
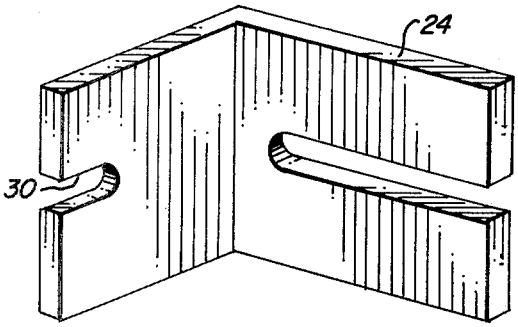
FIGS. 6 and 7 show details of parts of the assembly shown in FIG. 2.
Figure 7:
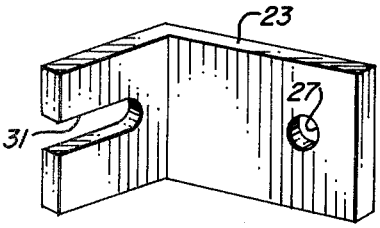

The extrusions 12 and 13 comprising the visible portions of the frame assembly are attached to the door frame opening on spaced steel angle brackets 23 and 24. These brackets are shown in detail in FIGS. 6 and 7. Each of them are simple, L-shaped anchor brackets which are attached to the wall 10 in the door frame opening by means of a screw (not shown) passing through the hole 27 in the bracket 23 and a screw 28 passing through the slot 30 in the bracket 24. The legs of the brackets 23 and 24 which extend outwardly from the wall when the brackets are in place have elongated slots 31 and 33, respectively, formed in them. These slots permit adjustment of the mounting location of the door frame extrusions 12 and 13 toward and away from the edge of the door opening to compensate for uneveness in the size of the opening and to compensate for errors in measurement in the formation of the rough opening in the door in which the frame assembly is placed.

Different numbers of the brackets 23 and 24 are used on each side of the door frame opening and on the top of the frame opening depending upon the weight of the door to be hung on the frame and other strength considerations. At least two of each of the brackets 23 and 24 should be used on each side of the door opening to mount the door frame extrusions 12 and 13 forming the frame assembly. Typically, the brackets 23 and 24 are formed of steel, although other high-strength materials could be used if desired.

the manner in which the door frame assembly is attached into the door opening formed in the wall 10 is best described in conjunction with reference to FIG. 2. The extrusion 12 is cut to length to go on either of the two sides of the door opening or the top. Then at least a pair of brackets 24 are slipped into position at spaced intervals between a pair of serrated jaws 35 and 36 formed on the back side of the extrusion 12. The details of these jaws are shown most clearly in FIG. 5 where it is apparent that the jaw 35 forms the first leg of the U-shaped extension on the extrusion 12 forming the door stop portion 16 of the extrusion. As stated previously, the door stop extension is terminated on the other side by the leg 18, again shown most clearly in FIG. 5. The distance between the jaws 35 and 36 is selected to be slightly larger than the thickness of the anchor bracket 24. The anchor bracket 24 is held in place between the jaws 35 and 36 by means of a bolt 37 which is tightened by means of a conventional nut.

Figure 9:
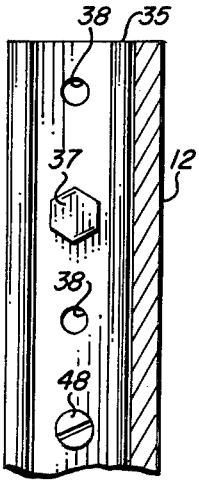
FIG. 9 shows details of the assembly of FIGS. 2 and 8.

The jaws 35 and 36 may have a series of spaced holes 38 formed through them at regular intervals throughout the length of the extrusion, or holes may be drilled through the jaws 35 and 36 at the locations directly adjacent the point where the jaws are to grip the anchor brackets 24. As illustrated in FIG. 9, a series of holes 38 are formed throughout the length of the extrusion, so that bolts 37 may be placed through these jaws at the desired point to grip the brackets 24. The nuts on the bolts 37 are tightened to lightly grip each of the anchor brackets 24 which are to be used in assembling the frame into the door opening.

The extrusion 12 with the brackets 24 held in place then is placed onto the wall at the door opening in the position shown in FIG. 2. Then the locations of the wall screws 28 are marked in the slots 30, the holes are drilled and the screws 28 are tightened to hold the anchor brackets 27 in place. Because of the manner in which the door stop portion 16 extends over the head of the screws 28, a hexagonal head which can be tightened with a wrench is employed for these screws.

Once the anchor brackets 24 are tightened in place, the bolts 37 can be loosened to permit adjustment of the door frame extrusion 12 with a level. After this adjustment has been accomplished, the bolts 37 once again are tightened to permanently lock the extrusion 12 in place as illustrated in FIG. 2. It should be noted that the distance of the extrusion 12 from the butt portion of the wall 10 forming the door opening also can be adjusted to accomodate for unevenness in the wall surface. The shorter leg of the cross-section of the extrusion 12 extends over the edge of the wall 10 and curves inwardly toward it to terminate in a neoprene cushion gasket 40 against the edge of the wall creating a tight seal between the wall and the extrusion 12. The neoprene gasket 40 also serves to compensate for minor unevenness in the wall surface against which the extrusion 12 abuts.

Figure 4:
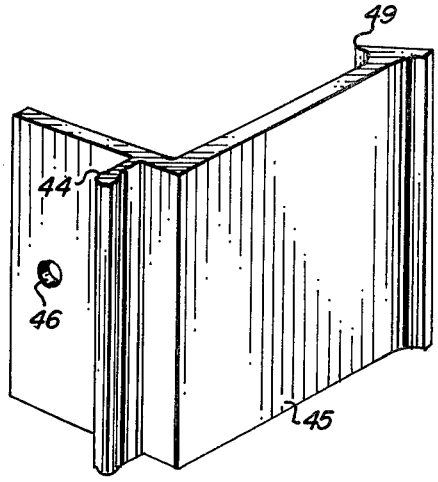

The reverse side of the jaw 36 has a C-shaped clamping extension 41 formed on it. This clamping extension is used to engage and hold a rounded pivot member 44 on an L-shaped clamping bracket 45, shown most clearly in FIG. 4. The clamping bracket 45 has one short leg on which the pivot 44 is formed and in which a hole 46 is drilled. The hole 46 is spaced toward the left (as viewed in FIGS. 2 and 4) of the pivot 44 a distance which causes it to align with the holes 38 formed through the jaws 35 and 36. A self tapping screw 48 then passes freely through the holes 38 in the jaws 35 and 36 to threadedly engage the hole 46 in the lever 45. Initially, the lever 45 is pivoted or rocked toward the right, as viewed in FIG. 2, to create a relatively large opening between an inwardly extending edge 49 on the long leg of he lever 45 and the edge of the inwardly turned leg 18 of the door stop part of the extrusion 12.

The anchor brackets 23 then are attached to the wall as shown in FIG. 2. Next, a steel support shaft 50, having a threaded portion at its lowermost end as viewed in FIG. 2, is inserted into the slot 31 of the anchor bracket 23 at a distance from the end of the wall 10 selected to hold the extrusion 13 in place in the position shown in FIG. 2. Once the shaft 50 is in the proper location, it is tightened by means of a screwdriver and wrench to be firmly held in position on the anchor bracket 23. The outer dimensions of the shaft 50 are selected to create a force fit between a pair of longitudinal flanges 51 and 52, which are formed on the inside of the shorter leg of the extrusion 13. Thus, the shaft 50, in conjunction with the flanges 51 and 52, stabilizes the door frame extrusion 13 in the door opening. As with the extrusion 12, the extrusion 13 has an inwardly turned end which terminates in a neoprene gasket 54 to seal the extrusion 13 against the wall 10, as shown most clearly in FIG. 2.

Once the two extrusions 12 and 13 are in place as described above, the self tapping screws 48 extending into each of the two or more brackets 45 are tightened to cause the brackets 45 to rotate counterclockwise as viewed in FIG. 2, pressing the sharp edge 49 into engagement with an opposing one of a series of parallel longitudinal serrations 57 formed on the inner surface of the portion 20 of the extrusion 13. The location of the edge 49 on the lever 45 is directly opposite the end of the leg 18 of the door stop portion of the extrusion 12. Thus, when the screw 48 is tightened to firmly press the edge 49 against the back side of the portion 20 of the extrusion 13, the portion 20 is clamped firmly between the edge 49 and the end of the leg 18. This creates a tight seal between the two extrusions 12 and 13, resulting in an attractive finished appearance.

After all of the screws 48 have been tightened, a neoprene gasket 60 is inserted into the slot formed above the heads of the screws 48 and the bolts 37 to conceal these screws and bolts from view and to act as a cushion for the door 14 when it is closed against the door stop portion of the extrusion 12.

Figure 5:
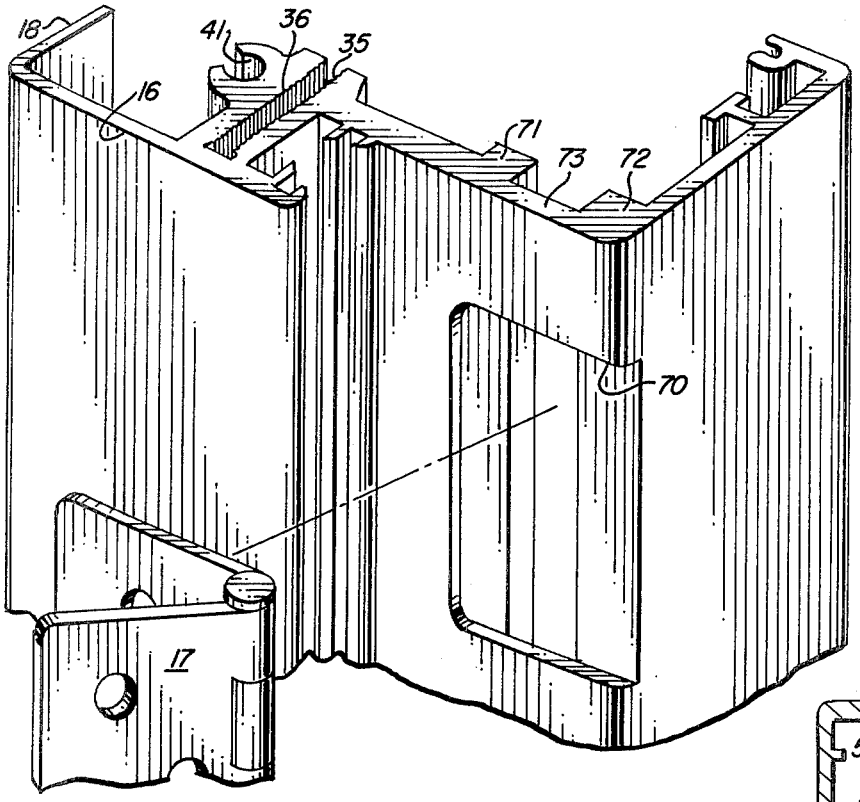
FIG. 5 illustrates details of another portion of the assembly shown in FIG. 2 and illustrates the manner of mounting a hinge in the assembly.

Once the extrusions have been assembled together, or before the final assembly, hinge receiving slots 70 are formed in the extrusion 12, as illustrated most clearly in FIG. 5. The extrusion 12 is constructed with a pair of thicker shoulders 71 and 72 extending throughout its length and spaced apart across a narrower bridge portion 73. When the slot 70 is cut into the extrusion 12, it is cut to a depth greater than the thickness of the bridge portion 73 to create an opening through the extrusion 12 into the space behind it. The hinge 17 then is placed into the opening 70 and abuts against the exposed portions of the shoulders 71 and 72 which firmly support it. A steel or aluminum plate 75 then is placed behind the shoulders 71 and 72, and self tapping screws are inserted through the hinge 17 into the plate 75 to clamp it firmly in place in the slot 70. This is done for each of the hinges 17 which are used to mount the door 14 in the final assembly.

Figure 8:
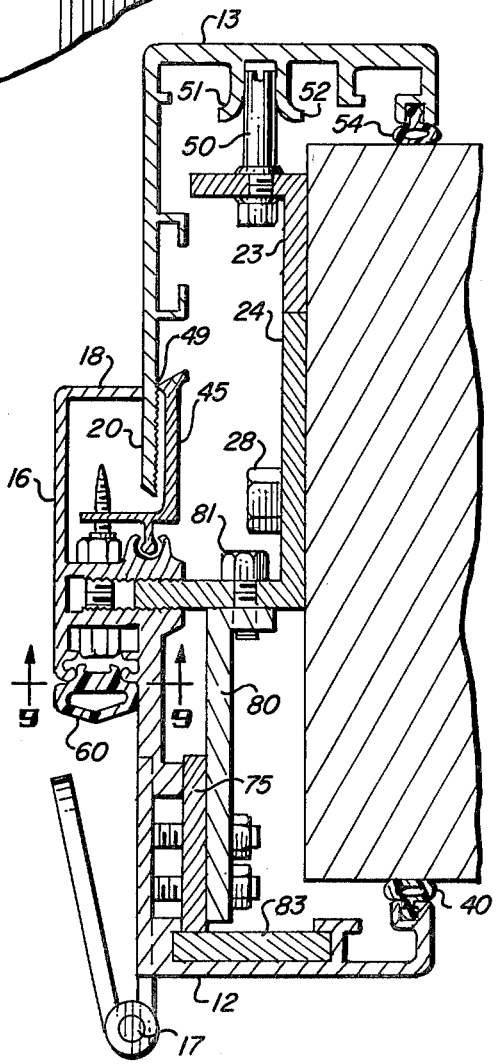
FIG. 8 is a cross-sectional view of a variation of the assembly shown in FIG. 2.

Reference now should be made to FIG. 8 which illustrates additions to the bracket assembly of the embodiment shown in FIG. 2. These additions are used for a fire resistant assembly. As is well known, aluminum, which is a desired material for the extrusions 12 and 13, has a relatively low melting temperature. Thus, if a fire were to occur in a building in which aluminum extrusions 12 and 13 are used for the door frame assembly, it is possible that the assembly could melt away and cause the door 14 to drop from the door opening. In many commercial buildings this would be wholly unacceptable since the door 14 then could not be utilized as a fire stop to prevent fire from spreading from room to room.

In locations where fire resistance is required, an additional steel anchor bracket extension 80 is bolted onto the bracket 24 by means of a bolt or threaded screw 81. The bracket 80 extends behind the steel hinge mounting plate 75, and the hinge is bolted into place through the plate 75 and the bracket 80. Thus, if a fire subsequently should melt away the aluminum door frame extrusions 12 and 13, the door 14 still would be held in place by the hinges 17 supported on the steel brackets 75, 80 and 24. Additional fire resistance is provided by inserting an elongated steel plate 83 into the reverse side of the extrusion 12 as illustrated in FIG. 8 and running entirely around the extrusion 12 on both sides and the top of the door opening.

The foregoing description and the drawings illustrate a preferred embodiment of the invention. This embodiment, however, is selected as illustrative and should not be considered as limiting of the invention which is defined in the following claims. Specifically, different types of materials may be substituted, if desired, for the materials which have been used in the description of the preferred embodiment; and other modifications will occur to those skilled in the art while still coming within the scope of the invention.

I claim:

1. A door frame assembly including in combination:

a first elongated part of uniform generally L-shaped cross section and having anchor gripping means integrally formed therewith;

a second elongated part of uniform generally L-shaped cross section and having anchor gripping means integrally formed therewith;

one of said first and second parts having a door stop extension thereon adapted to overlap the other of said first and second parts when said parts are placed on opposite sides of a door opening and moved toward one another; and an L-shaped clamping lever pivotally attached to said one of said first and second parts for engagement with said other of said first and second parts on the opposite side of said other of said parts from the side overlapped by the door stop extension of said one of said parts.

2. The combination according to claim 1 further including hinge mounting means for supporting door hinges in said one of said first and second parts.

3. The combination according to claim 2 further including fire resistant plate means fastened to said hinge mounting means and adapted to be fastened to an anchor attached to the door frame opening for supporting said hinges independently of said one of said first and second parts.

4. The combination according to claim 1 further including means for biasing said L-shaped clamping lever into engagement with said other of said parts.

5. The combination according to claim 4 wherein said first and second parts each are extrusions; said door stop extension comprises a generally U-shaped extension on one of the legs of said one of said L-shaped extrusions; and said biasing means comprises a threaded fastener passing through one of the legs of said U-shaped extension and threadedly engaging said clamping lever on one side of the pivot thereof to rock said lever about said pivot to cause the other end thereof to engage said other of said extrusions.

6. The combination according to claim 5 wherein said other of said extrusions has longitudinally formed serrations on the side thereof engaged by said clamping lever, and said other end of said clamping lever has a projection thereon for engagement with said serrations.

7. The combination according to claim 6 wherein said other end of said clamping lever engages said other of said extrusions directly opposite one of the legs of said U-shaped door stop extension.

8. The combination according to claim 5 wherein the anchor gripping means of said one of said first and second extrusions comprises a generally U-shaped clamping member, one leg of which is formed as part of said door stop extension and the other leg of which is formed intermediate the legs of said door stop extension, the distance between the legs of said U-shaped anchor gripping means adapted to straddle an anchor plate; and means for biasing the open ends of said U-shaped anchor gripping means together to grip an anchor plate.

9. The combination according to claim 8 wherein said biasing means comprises a threaded fastener.

* * * * *